United States Patent [19]

Weidler

[11] Patent Number: 4,530,560

[45] Date of Patent: Jul. 23, 1985

[54] PLUG AND SOCKET CONNECTOR FOR TERMINATING SMALL GAUGE MAGNET WIRE

[75] Inventor: Charles H. Weidler, Lancaster, Pa.

[73] Assignee: AMP Incorporated, Harrisburg, Pa.

[21] Appl. No.: 625,992

[22] Filed: Jun. 29, 1984

[51] Int. Cl.[3] ..... H01R 4/24

[52] U.S. Cl. ..... 339/97 R; 339/256 C; 339/273 R

[58] Field of Search ..... 339/95 R, 95 A, 96, 339/97 R, 98, 252 R, 256 R, 256 C, 273 R, 273 F, 273 S

[56] References Cited

U.S. PATENT DOCUMENTS

| | | | |
|---|---|---|---|
| 3,744,006 | 7/1973 | O'Loughlin | 339/97 R |
| 4,026,013 | 5/1977 | Hughes | 339/97 R |
| 4,152,686 | 5/1979 | Hughes | 339/273 R |

*Primary Examiner*—Neil Abrams
*Attorney, Agent, or Firm*—Robert W. J. Usher

[57] ABSTRACT

An electrical connector for terminating small gauge magnet wire comprising a resilient, tubular socket (11) having a serrated, internal, wire engaging surface (18) and a plug (13) having an enlarged head (28) at a leading end and a wire supporting surface (27) at a trailing end. The plug head (28) expands the socket (11) during movement therethrough to permit the wire supporting surface (27) to be freely received in the socket (11) until opposite the wire engaging surface (18). Exit of the head (28) from an exit end of the socket (11) permits resilient contraction of the socket (11) to press the wire engaging surface against the wire supporting surface so that the serrations effect connection to the wire at multiple points therealong.

8 Claims, 4 Drawing Figures

PLUG AND SOCKET CONNECTOR FOR TERMINATING SMALL GAUGE MAGNET WIRE

The invention relates to an electrical connector for terminating fine wires, for example magnet wires and, in particular, for terminating magnet wires of small gauge.

Magnet wires are fine wires having a single strand core covered by a thin layer of insulation such as varnish. Magnet wires of small guage may have a core diameter as small as 0.0015 inches.

Various proposals have been made for terminating magnet wires with coil windings on stator housings, in particular, those described in U.S. Pat. No. 4,130,331 and 4,118,103 in which a wire is located across a gap in a cavity in an insulating housing formed integrally with the stator housing and a terminal having an open slot is inserted into the cavity so that opposite walls of the slot straddle the wire and penetrate the insulation to establish permanent electrical connection to the core. Tangs are provided on the terminal to engage the housing cavity wall during insertion into the housing to retain the terminal in the cavity terminating the wire.

However, a disadvantage of these prior proposals is that the walls or edges of the slot only effect connection to a relatively small area of wire core, i.e., at a single axial location on the wire. Furthermore, difficulties have been experienced in extending this technique to magnet wires of small gauge in view of their fragility.

One development of this technique is taught in U.S. Pat. No. 4,183,607 in which a wire supporting stuffer is received in the wire connecting slot itself in addition to the wire with the result that the wire is jammed between the wall of the stuffer and the slot wall.

Whilst this provides increased support for the wire during termination, connection is effected to only one side of the wire and the risk of severing the wire as a result of too large manufacturing tolerances remains.

In yet another proposal, terminals having substantially closed slots formed by shearing are used in an attempt to effect connection to the small gauge magnet wires. However, the last-mentioned proposal has still not been entirely satisfactory with the smallest gauge magnet wires having diameters of about 0.0015 inches.

In summary, all the above-mentioned proposals require the manipulation of very small parts with insulating houses moulded to very close tolerances while only a very small contact area is achieved. In view of the axial movement of the slot wall or edge transversely of the wire, there remains a risk of severing the wire if the tolerances are not met both in the parts and in the assembly tooling.

U.S. Pat. No. 4,026,013 describes another proposal which attempts to effect multiple connections to a magnet wire axially of its length by pressing the wire between the wall of a housing and a serrated wire engaging surface of a contact. However, the contact force is provided by deformation of the contact from a generally parallelogram configuration to a rectangular configuration during insertion of the contact into the housing by engagement of a leading corner of the contact with an end wall of the housing. This has not proved entirely satisfactory with the small gauge magnet wires in view of the relative movement and substantial forces are transmitted to the insulating housing which may cause damage thereto.

An object of the invention is to provide a connector for terminating small gauge magnet wire which connector is economical to manufacture and assemble by conventional mass production techniques, and which makes multiple connections with the wire along its length without risk of breaking the wire.

According to the invention, there is provided an electrical connector for terminating small guage magnet wire comprising a resilient, tubular socket having entry and exit ends, a wall portion of the socket defining an internal wire engaging surface provided with a series of serrations and a contact portion extending from the socket; a plug member having a wire supporting surface receivable in the socket in an interference fit with the wire engaging surface and a head of increased width on a leading end whereby insertion of the plug through the entry end along the socket expands the socket so that the wire engaging surface is maintained spaced from a wire supported on the wire supporting surface of the plug until the surfaces are opposite, when exit of the head of the plug from the exit end permits the socket to resile to bring the serrations on the wire engaging surface into engagement with the wire to penetrate the insulation and effect multiple connections thereto.

Thus there is no significant shift of the serrated wire engaging surface along the wire at any stage of engagement avoiding any risk of breaking the extremely fragile wire.

Preferably, the socket is of varying width, the socket portion defining the wire engaging surface being located adjacent the entry end and freely receiving the head of the plug.

Conveniently, the socket is of frustoconical shape tapering as it extends away from the entry end and the contact portion has a root end struck out from the socket adjacent the exit end providing clearance for the exit of the head portion of the plug. This frees the exit end of the socket to resile behind the head of the plug.

An example of the invention will now be described with reference to the accompanying drawings in which.

Figure 1:
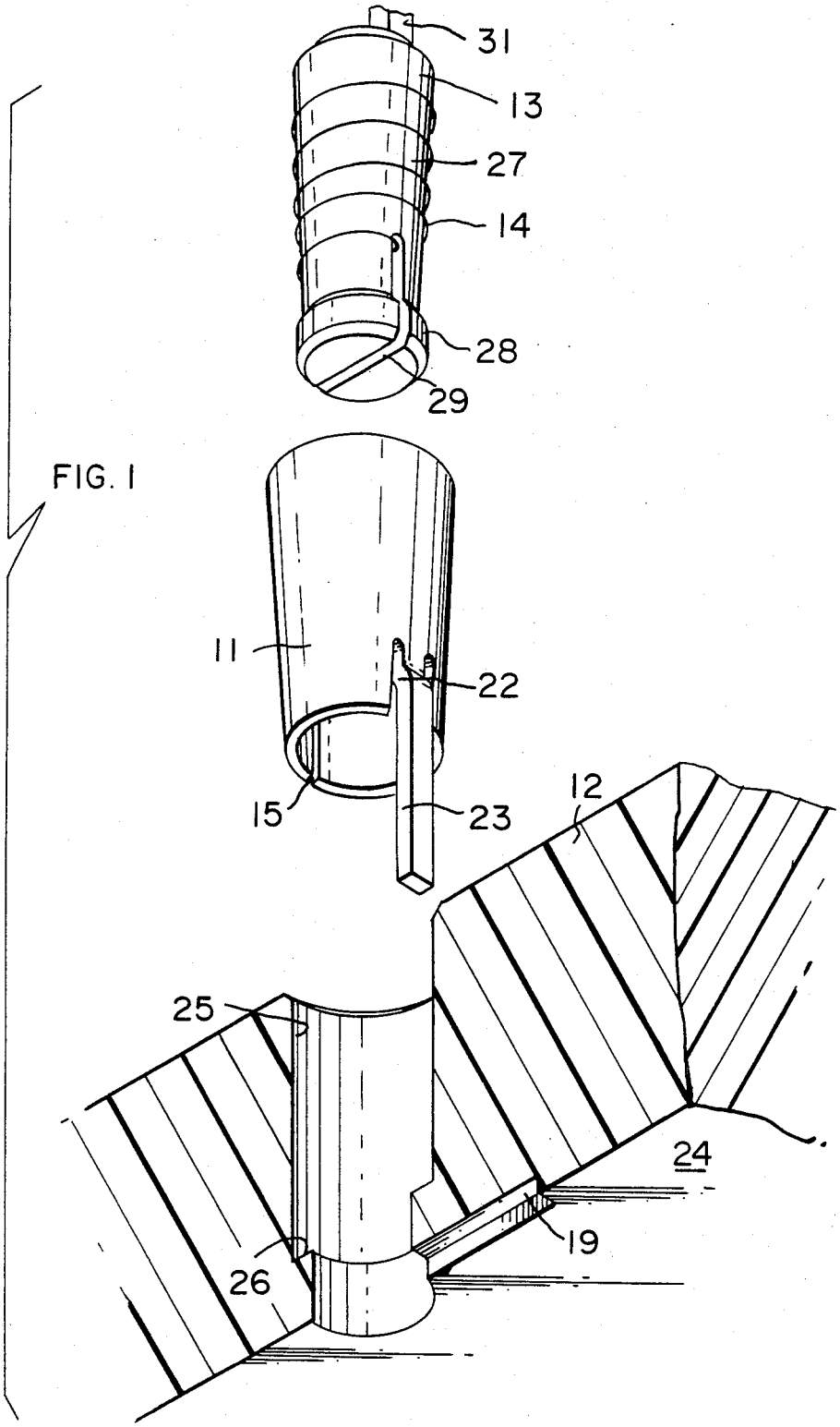
FIG. 1 is an exploded perspective view of the electrical connector prior to assembly of a socket into a housing.
Figure 2:
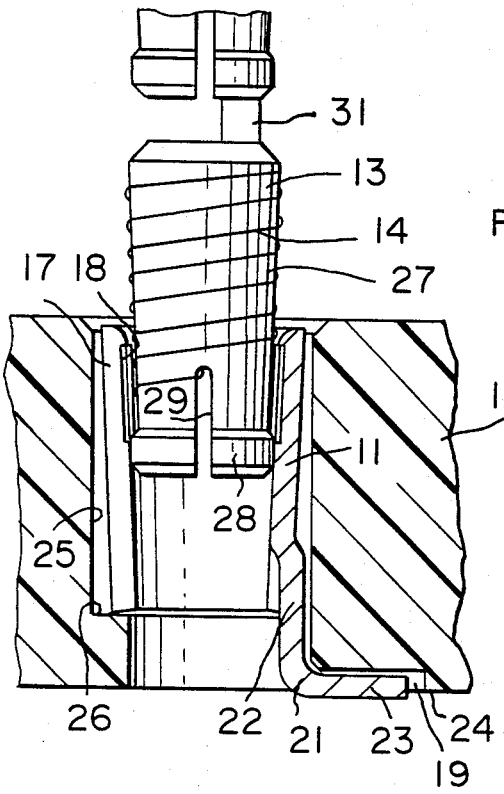
FIG. 2 is a cross-sectional view showing the plug member of the connector in a partly inserted condition in the socket member.

The connector comprises a tubular socket 11 mounted in a housing 12 and a complementary plug member 13 carrying a wire 14.

The socket 11 is stamped and formed from a single piece of sheet metal into a frustoconical shape tapering from entry to exit ends and having an axially extending open seam 15. A wall portion 17 of the socket adjacent the entry end defines an internal wire engaging surface 18 provided with a series of axially extending serrations, the remainder of the internal surface of the socket being smooth. A contact tongue 21 has a root end 22 struck out from the socket wall adjacent the exit end to extend in the axial direction and a free end 23 bent to extend radially outwardly, and is located in a groove 19 in the underside of a base 24 of the housing for connection, for example, to the face of a printed circuit board.

The socket is mounted in a suitably sized cavity 25 in the housing by insertion therein exit end leading and with the tongue in straight condition. The cavity accommodates free expansion of the socket, the exit end of which is supported by a step 26 in the cavity wall.

The plug member 13 is moulded in one piece of suitable insulating material with a frustoconical wire supporting surface 27 receivable as an interference fit in the socket and which tapers towards a leading end of the plug which is formed with a head 28 of increased width having an axially extending wire receiving slot 29 open to the leading end.

In use of the connector, a magnet wire 14 is drawn into the slot 29 and coiled around the wire supporting surface 27. The plug is then inserted into the entry end and moved along the socket. The wall portion 17 defining the wire engaging surface is of greater width than the head 28 of the plug to admit it freely avoiding any risk of blunting the serrations by engagement with the plug. However, between the wire engaging and the exit end the socket male portion 20 is of less width than the plug head 28 which therefore expands the socket radially to permit the wire supporting portion of the plug to carry the wire into alignment with the wire engaging surface of the socket without engagement with the surface 18.

Figure 3:
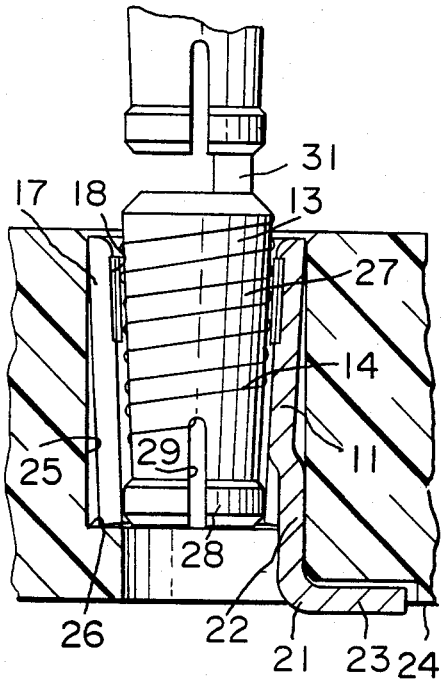
FIG. 3 is a similar view to FIG. 2 but with the plug member inserted further into the socket.
Figure 4:
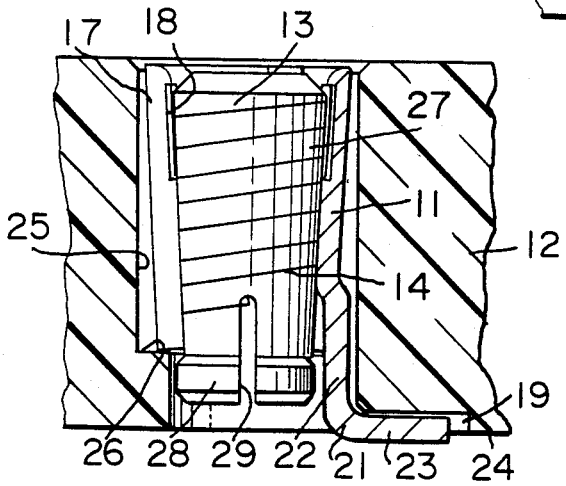
FIG. 4 is a similar view to FIG. 2 but with the plug member in the fully inserted condition.

As shown in FIG. 3, exit of the plug head through the exit end when the wire supporting and wire engaging surfaces are opposite enables the wire engaging portion of the socket to resile back into engagement with the wire on the wire supporting surface of the plug so that the serrations penetrate the insulation and effect multiple connections along the wire. The socket wall snaps behind the plug head at the exit end to secure the plug in the socket.

Thus, a reliable connection to fragile magnet wire of small gauge can be readily effected without a need for maintaining the very close tolerances in either component parts or assembly tooling as there is no significant risk of fracturing the wire. In addition, risk of fracturing the wire is avoided as the surfaces move substantially perpendicularly together.

The contact tongue need not be flat but may be formed into any suitable contact shape and the plug members may be moulded as a continuous stick with adjacent plug members joined by integral webs 31 severed by suitable assembly tooling immediately prior to insertion of the plug member into the socket.

What is claimed is:

1. An electrical connector for terminating small gauge magnet wire comprising a resilient, tubular socket having entry and exit ends, a wall portion of the socket defining an internal wire engaging surface provided with a series of serrations and a contact portion extending from the socket; a plug member having a wire supporting surface receivable in the socket in an interference fit with the wire engaging surface and a head of increased width on a leading end whereby insertion of the plug through the entry end along the socket expands the socket so that the wire engaging surface is maintained spaced from a wire supported on the wire supporting surface of the plug until the surfaces are opposite, when exit of the head of the plug from the exit end permits the socket to resile to bring the serrations on the wire engaging surface into engagement with the wire to penetrate the insulation and effect multiple connections thereto.

2. An electrical connector according to claim 1 in which the socket is of varying width, the socket portion defining the wire engaging surface being located adjacent the entry end and of increased width freely to receive the head of the plug.

3. An electrical connector according to claim 2 in which the socket is of frustoconical shape tapering as it extends away from the entry end.

4. An electrical connector according to claim 1 in which the contact portion has a root end struck out from the socket adjacent the exit end providing clearance for the exit of the head of the plug.

5. An electrical connector according to claim 1 in which the socket is stamped and formed with an axially extending open seam.

6. An electrical connector according to claim 1 in which the socket is mounted as a free fit in a cavity in a housing.

7. An electrical connector according to claim 1 in which a wire receiving slot is formed in the head of the plug member.

8. An electrical connector according to claim 1 in which the plugs have been moulded in plastics material as an integral stick joined end-to-end by severable portions.

* * * * *